US006619709B1

(12) United States Patent
Mönig et al.

(10) Patent No.: US 6,619,709 B1
(45) Date of Patent: Sep. 16, 2003

(54) EXTERIOR DOOR HANDLE, IN PARTICULAR FOR VEHICLES

(75) Inventors: Stefan Mönig, Schwelm (DE); Manfred Rohlfing, Essen (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/069,610

(22) PCT Filed: Aug. 9, 2000

(86) PCT No.: PCT/EP00/07725

§ 371 (c)(1),
(2), (4) Date: Jun. 3, 2002

(87) PCT Pub. No.: WO01/14666

PCT Pub. Date: Mar. 1, 2001

(30) Foreign Application Priority Data

Aug. 25, 1999 (DE) ..... 199 40 379

(51) Int. Cl.[7] ..... E05B 3/00
(52) U.S. Cl. ..... 292/336.3; 292/348; 16/412
(58) Field of Search ..... 292/336.3, 347, 292/348, 353, DIG. 53; 16/412

(56) References Cited

U.S. PATENT DOCUMENTS 4,038,718 A * 8/1977 Reilhac ..... 16/110 R
5,101,597 A * 4/1992 Pelachyk ..... 49/460
5,174,619 A * 12/1992 Bender ..... 292/336.3
5,238,276 A * 8/1993 Burns ..... 292/347
5,340,174 A * 8/1994 Bender ..... 292/336.3
6,059,329 A * 5/2000 Spitzley ..... 292/336.3

FOREIGN PATENT DOCUMENTS

| | | |
|---|---|---|
| DE | 4445320 | 8/1996 |
| EP | 0646688 | 4/1995 |
| FR | 2644199 | 9/1990 |

* cited by examiner

*Primary Examiner*—Gary Estremsky
(74) *Attorney, Agent, or Firm*—Friedrich Kueffner

(57) ABSTRACT

The invention relates to a door handle, comprising a handle located on the visible side of the door and a support (10) for said handle which is fixed onto the reverse side of the door. The handle has connecting elements at both extremities which penetrate recesses in the door, whereby one extremity is connected to a lever (13') which is mounted on a pivoting support (10). A housing which can contain a locking cylinder is inserted into the support (10) next to the handle. According to the invention, in order to simplify the assembly of the handle, a retaining element (25) is positioned between the support (10) and the lever (13') which, in its usual active retaining position, secures the lever in a defined pivoted position, pointing outwards. The handle can be connected easily to the lever in this pivoted position. However, when the housing is inserted into the support, the retaining element (25) is displaced into its inactive position, where it releases the lever (13').

5 Claims, 4 Drawing Sheets

EXTERIOR DOOR HANDLE, IN PARTICULAR FOR VEHICLES

BACKGROUND OF THE INVENTION

The invention relates to a door handle for a vehicle. The supporting member, on the one hand, and the handle, on the other hand, are connected to each other at the door, in particular, on a door skin, from opposite sides. Such an exterior door handle is known from DE 44 45 320 A1. Such exterior door handles have at least one lever pivotably supported on the supporting member to which the handle is attached with its one handle end. In order to be able to accomplish this easily, the lever must be positioned in a specific rotated position. In order to achieve this, the prior art requires stopping elements which are difficult to handle.

SUMMARY OF THE INVENTION

The object of the invention is to develop an inexpensive door handle of the aforementioned kind, which can be mounted on the door easily and quickly. This is accomplished, according to the invention, in that a retaining element, controlled automatically between an active retaining position and an inactive release position, is arranged between the supporting member and the lever, in that, when mounting the supporting member on the door, the retaining element for connecting the handle is first positioned in its retaining position in which it holds the lever in its rotated position, and that the casing upon insertion into the supporting member automatically moves the retaining element into its release position, where the lever is released.

There are external door handles of a different type in which the handle is initially preassembled with the supporting member and forms a complete structural unit which is mounted only subsequently as a whole unit in a door cutout. For this purpose, the structural unit is passed through a setting movement from the outer door side into the door cutout of the door skin. The supporting member is provided with locking elements which are first in an inoperative position and moved to the rear side of the door skin, while border zones of the supporting member rest against the exposed side of the door skin. The locking elements are then transferred into their operative position where they engage behind the rear side of the door skin and fasten the structural unit at the door in this manner.

There are also external door handles in which the transfer of the locking elements from their inoperative position into their operative position is effected by a first actuation of the handle. In DE 44 43 117 A1, the locking elements are composed of a slide member which is longitudinally guided on the rear side of the supporting member. The manipulating device mounted, on the supporting member has a cam which, when the handle is actuated, makes contact with the slide member and transfers the slide member into its operative position. In EP 0 724 052 B1 and DE 696 03 756 T2, the locking elements are composed of a wedge which is pushed by a cam at the handle during the actuation of the handle underneath the beam of a T-shaped retaining element which is arranged in the border area of the supporting member. In this case, in addition to the door cutout in the door skin, slots are necessary in the door skin in order to thread the T-beam during the assembly of the structural unit therethrough. Because of the already completely preassembled structural unit, it is also in these external door handles not necessary to pay attention to the connection of the handle to the supporting element during the assembly.

In the external door handles according to the preamble of claim 1, initially the supporting member is fastened to the rear side of the door and only then is the handle mounted from the outer side of the door. It is important to connect at least one handle end of the handle to a lever which is already pivotally mounted on the attached supporting member. In order to facilitate this connection of the handle end to the lever, it is important to transfer the lever into a rotated-out position near the door cutout and to maintain this rotated-out position until the connection of the handle is completed. For this purpose, locking means were required in the prior art, for example, screws which had to be moved in a cumbersome manner into their locking positions and then had to be released again from the locking positions.

The object of the invention is to develop an inexpensive door handle of the kind described in the preamble of claim 1, which makes it possible to easily and quickly assemble the supporting member and the handle. This is accomplished, according to the invention, by the features specified in claim 1, which have the following special meaning.

In the external door handle according to the invention, a retaining element is used which is a fixed component of the support member or lever and usually, as long as the casing is not yet inserted into the supporting member, retains the lever in a defined rotated position. This supporting member is always effective without casing, so that the lever only has to be rotated outwardly by an appropriate extent in order to secure the lever in the desired rotated position. The assembly of the handle on the rotated lever can then be carried out.

A deactivation of the supporting member also does not require a separate actuation because the insertion movement of the casing in the supporting member assumes this function. It is sufficient to insert the casing as intended at the prescribed location in the supporting member from the outer side of the door. This insertion movement of the casing is utilized for transferring the retaining element into its release position. The lever is released from then on and permits the unhindered actuation of the handle at the door.

Consequently, the disassembly of the handle from the supporting member can be carried out in a similarly simple manner as the above-described assembly. It is sufficient for this purpose to pull the casing once again out of the supporting member. The retaining element then once again becomes operative and, for this reason, the rotated position of the lever is once again secured during the subsequent actuation of the handle. The handle can then be easily and quickly separated from the lever and be replaced by a new handle. Accordingly, the activation and deactivation of the retaining element during the assembly and disassembly takes place automatically as a result of the removal and insertion of the casing in the supporting member.

BRIEF DESCRIPTION OF THE DRAWINGS

Further measures and advantages of the invention follow from the dependent claims, the following description, and the drawings. The drawings illustrate one embodiment of the invention. It is shown in:

DESCRIPTION OF PREFERRED EMBODIMENTS

Figure 1:
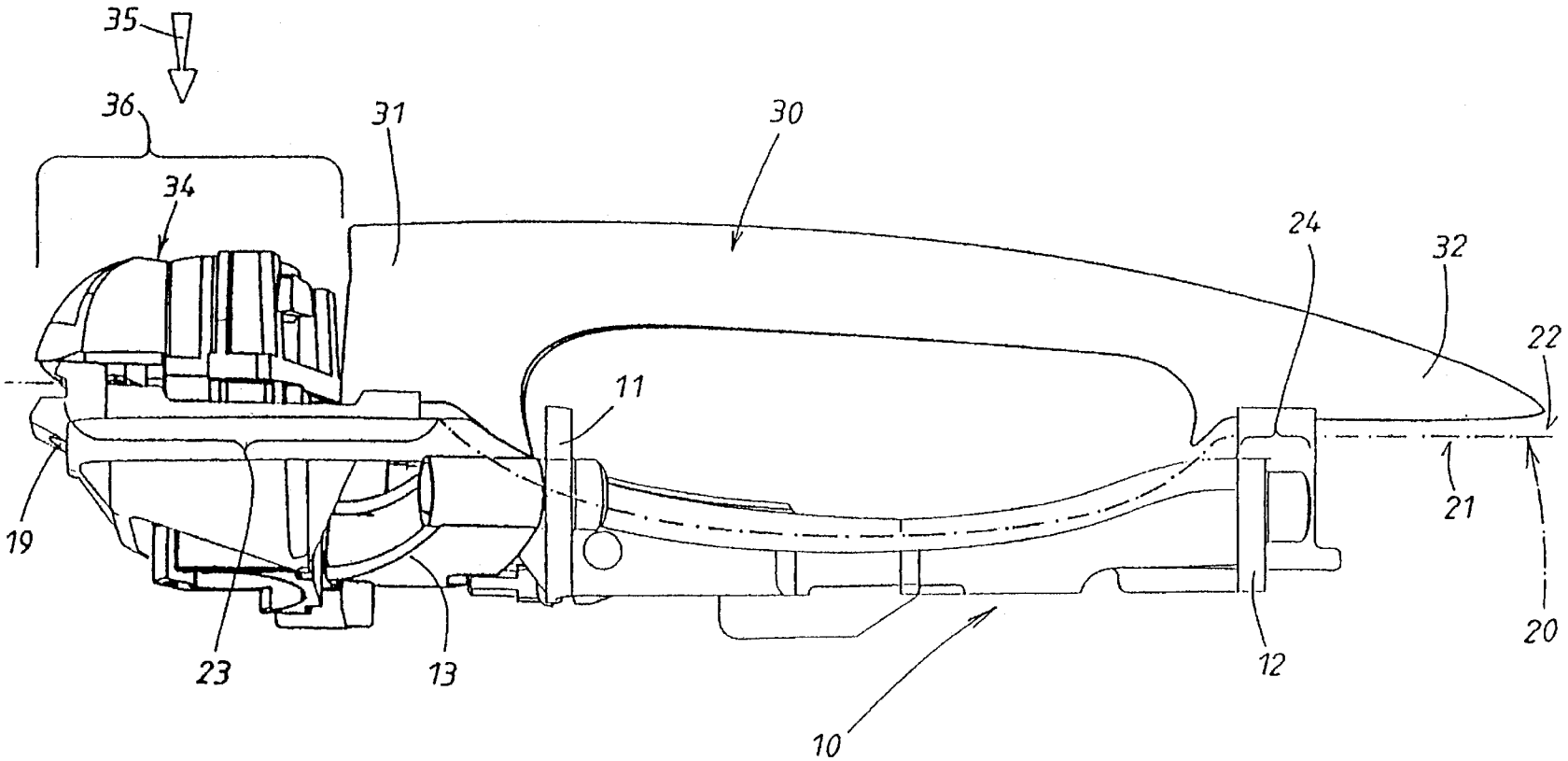
FIG. 1 a plan view of the door handle according to the invention, showing in a dash-dotted line the course of the door panel determining the exterior side of the door.
Figure 2:
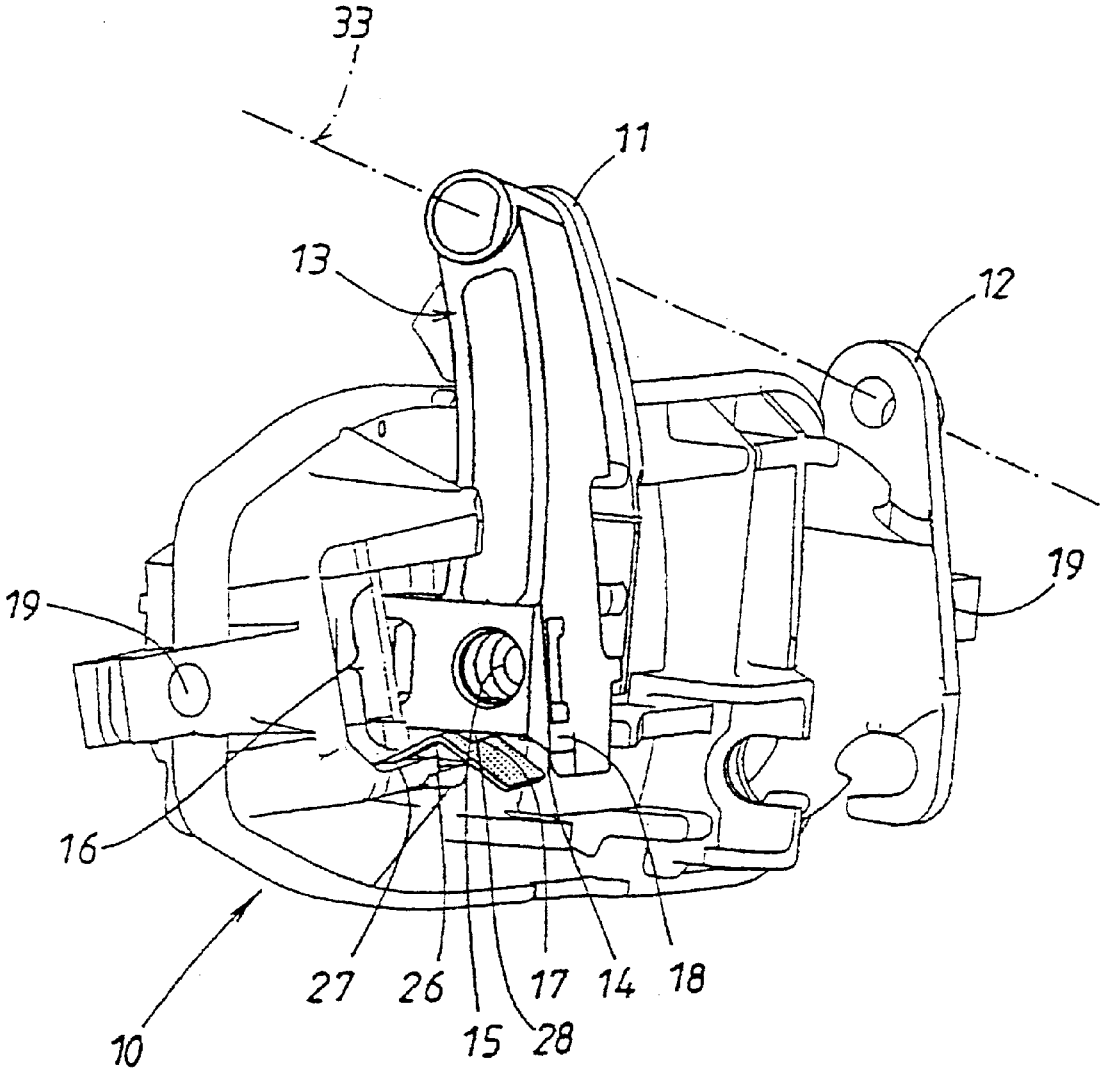
FIGS. 2–4 rear perspective views of the lock shown in FIG. 1, the handle not being illustrated and the components being shown in three different positions.

The exterior door handle as shown-on the door comprises a supporting member 10 mounted by means not illustrated on the back side 21, shown in FIG. 1, of a metal door panel 20 defining the door. A handle 30 is located on the opposite exposed side 22 which has a bow-shaped design and preferably is comprised of a lift-bar-type handle. This handle 30, not shown in FIG. 2, is supported by means of a hinge axle 33, indicated in a dash-dotted line running slantedly in this illustration, on the bearing brackets identified at 11 and 12. This is accomplished in an indirect way at least at the bearing bracket 11, i.e., by means of a lever 13 pivotally supported at that location. The lever 13 is realized in this embodiment as a "rocker". In the illustrated embodiment, a short lever is also provided at the other bearing bracket 12.

The metal door panel 20 is provided first with two recesses 23, 24 through which the handle 30, when it is mounted, protrudes with connecting elements, not shown in detail in this context, provided on its two handle ends 31, 32. One handle end 31 is attached with its connecting element to the free end 14 of the lever 13, for which purpose the hole-shaped attaching location 15 within the arm is shown in FIG. 2. Another attaching location provided on the arm of the lever 13 and located further forwardly is not shown. In the present case, the other handle end 32 is connected by a connecting element to the above-mentioned short lever of the bearing bracket 12.

Figure 3:
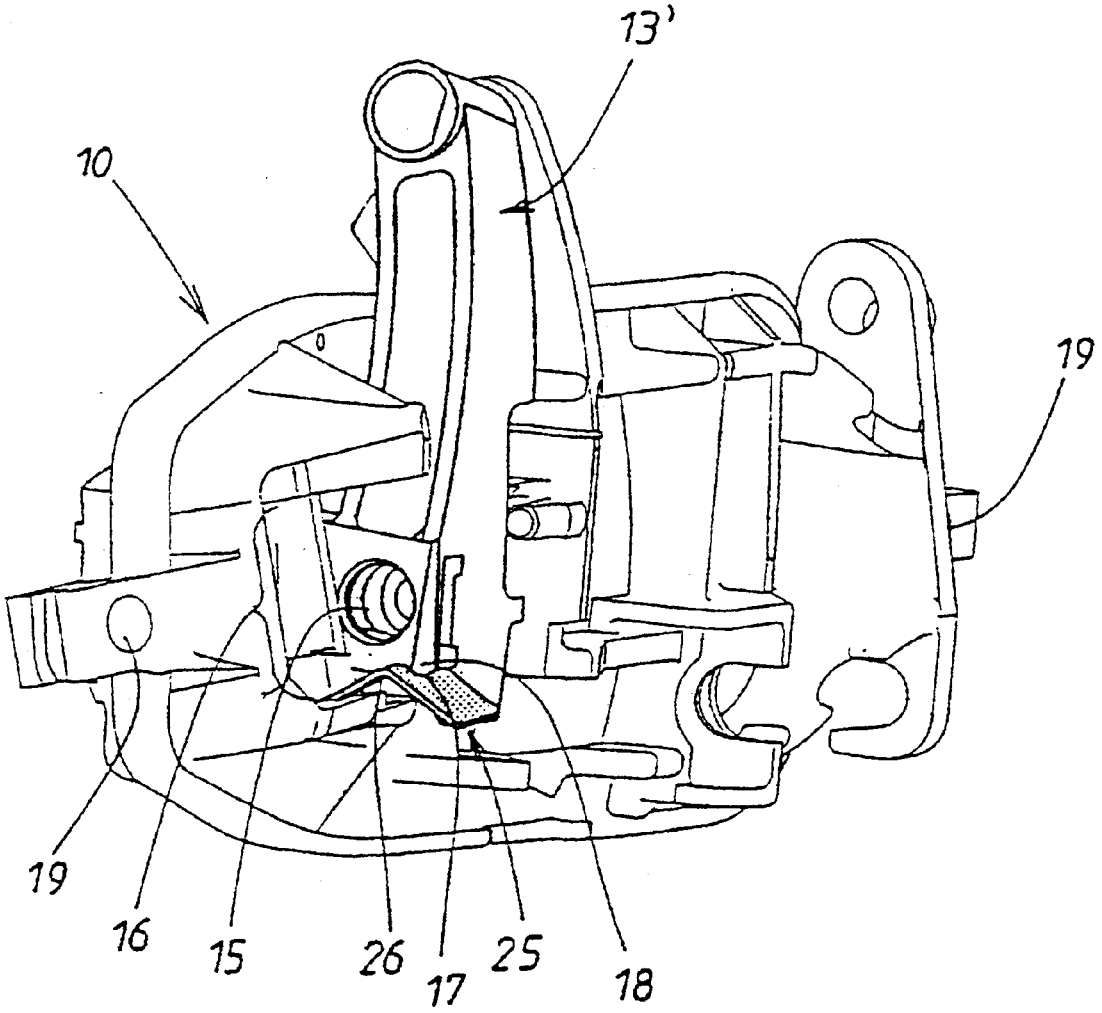
Figure 4:
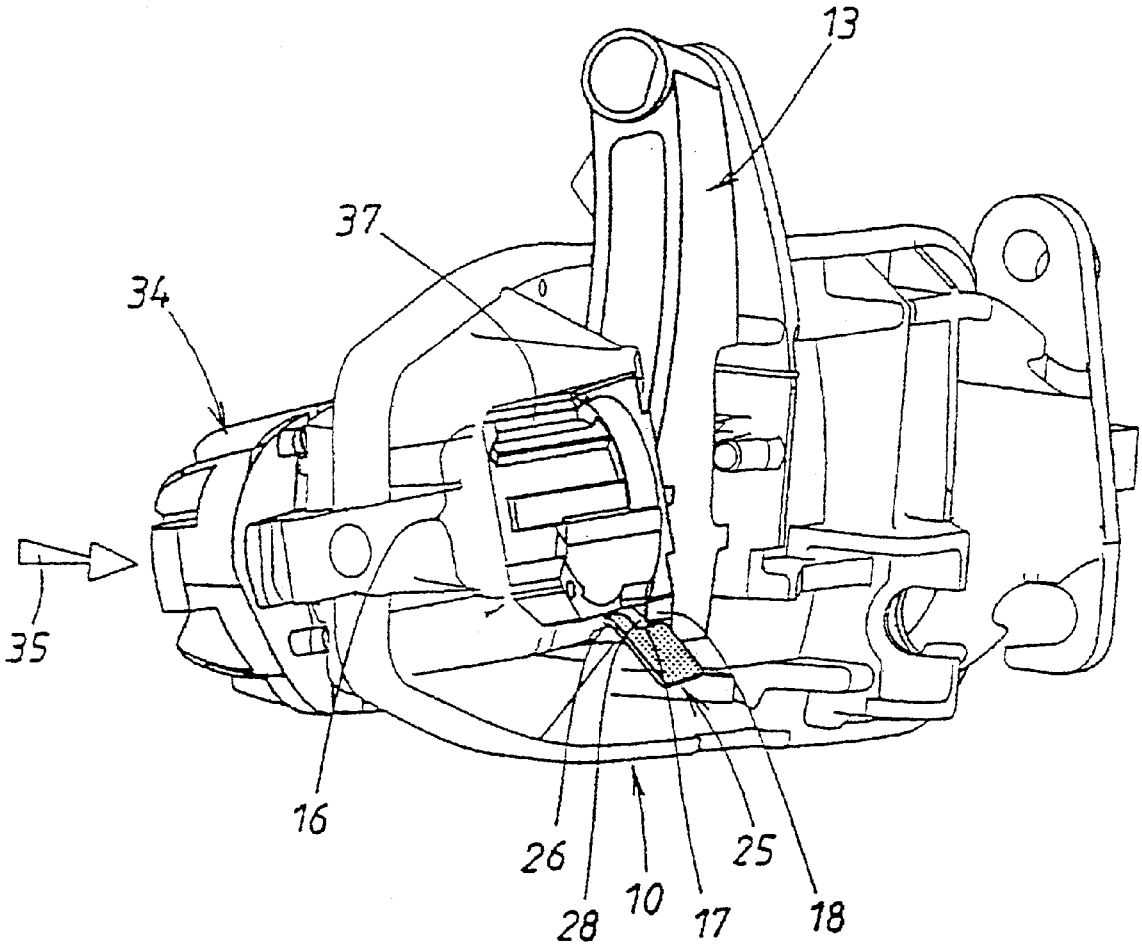

In the area next to the handle 30, a casing 34, as shown in FIGS. 1 and 4, is mounted which in the present case also comprises a lock cylinder, not illustrated. This casing is inserted in the direction of the inserting arrow 35 into the supporting member 10 from the exterior side of the door and fastened thereat. This casing 34 takes up the space 36 next to the handle 30. Suitable covering elements seated on the casing 34 may also be provided within this space 36 and can realize a pleasing appearance of the door handle corresponding to and in conformity with the handle 30. For supporting the casing 34, the supporting member 10 is provided with a receiving portion 16 shown in FIG. 2. The inserted position of the casing 34 in this receiving portion 16 is shown in FIG. 4. Here, the casing 34 protrudes with its inner end 37 from the rear side of the supporting member 10 and cooperates with a special retaining element 25 whose design and function can also be seen in connection with FIGS. 2 and 3.

When the handle 30 is properly actuated, the-handle is moved about the hinge axle 33, here shown to be slanted relative to the horizontal. The rest position of the handle 30 is illustrated in FIG. 1. In its actuated position, the handle 30 is rotated farther away from the metal door panel 20, but is returned to its rest position by springs, not illustrated in detail in this context. As has already been mentioned, this movement is controlled by the lever 13 which is moved by this rotating movement from its rest position shown in FIG. 4 into a corresponding outwardly rotated position. This outwardly directed end position or a rotated position 13', that at least comes close to it and is shown in FIG. 3, is required or at least useful, when the handle 30 is to be mounted from the exterior on the supporting member 10 already seated on the door. In this rotated position 13'according to FIG. 3 the attaching locations 15 provided on the lever are positioned favorably. This can also apply to the connection at the aforementioned short lever at the bearing bracket 12. The special retaining element 25 takes care of this, in particular automatically.

FIG. 2 illustrates the mounting position of the supporting member 10 required for mounting it, as has already been mentioned, to the back side 21 of the metal door panel 20. The attachment of the supporting member 10 is realized via the connecting locations identified at 19 in FIG. 2. The retaining element 25 consists of a leaf spring indicated in the Figures in dash-dotted lines and is provided with a V-shaped bent element 26. The leaf spring is attached with its one fixed end 27 on the supporting member 10 and cooperates with its opposite free spring end with the lever 13. At its end portion, the leaf spring is provided with a cutout 28 bordered by an edge 17. The lever 13 is accordingly provided with a shoulder 18 positioned, in the mounting position of the supporting member 10, on the metal door panel 20 behind the V-shaped bent element 26 of the leaf spring, as viewed from the front side of the door. The V-shaped bent element 26 can be supported on the horizontal arm of the lever in a springy fashion or can rest next to the arm of the lever 13.

FIG. 3 shows a mounting position of the supporting member 10. In this case, the already mentioned specific rotated position 13' of the lever is secured by the leaf spring. This is accomplished in that the elastic leaf spring engages from behind with its edge 17 provided at the cutout 28 the already mentioned shoulder 18 of the lever. This shoulder 18 is simply formed by the rear surface of the lever positioned in the rotated position 13'. The leaf spring engages from behind a shoulder 18 formed by an edge and shown in FIG. 3. The leaf spring is positioned in its active holding position. In this mounting position of FIG. 3, the rotated position 13' of the lever is secured in this way. In this rotated position 13', the handle 30, as has already been mentioned, can be mounted easily on the arms of the lever 13' or of the already mentioned small lever on the exposed side of the metal door panel 20. The connecting portions of these levers protrude through the recesses 23, 24 and are easily accessible for the mounting steps.

After mounting the handle 30 on the lever 13, it is important to deactivate the leaf spring so that the lever 13 can again perform its rotating movement without any interference. This is carried out automatically according to the invention by inserting the casing, as has already been described, in the direction of arrow 35 of FIGS. 1 and 4. This insertion movement 35 occurs regularly after mounting the handle 30. This occurs because the leaf spring reaches with its V-shaped bent element 26 into this insertion path in the interior of the receiving portion 16 of the supporting member, which can also be seen in FIG. 3. That portion of the leaf spring which lies in front of the V-shaped element 26 serves as a "guiding ramp" for the casing 34. When inserted, the inner end of the casing pushes against the V-shaped portion of the leaf spring, according to FIG. 4, and pushes it into its deactivated position, as illustrated in FIG. 4. The spring is increasingly extended and the holding edge 17 releases the shoulder 18 of the lever that is still positioned in its rotated position 13'. The lever 13 is subsequently moved into its rest position by the above-mentioned restoring spring not illustrated in detail.

Should the door handle be demounted from the metal door panel 20 and be replaced, for example, by a new one, the casing 34 is pulled out of the supporting member 10 in a direction opposite to the insertion arrow 35. At that time, the leaf spring is again free and moves because of its elasticity automatically into its active position according to FIG. 2. When the lever 13 is subsequently again positioned in its rotated position 13' shown in FIG. 3, the rear shoulder 18 of the lever engages behind the cutout edge 17 of the leaf spring. This occurs again entirely automatically. The leaf spring can now be readily used again for a new mounting of the handle 30. Special manipulations for securing the lever 13 in its rotated position 13' are unnecessary according to the invention.

It is understood that the retaining element 25 can be embodied in a different way in place of a leaf spring. It could, for example, consist of catching noses and catching projections, which, optionally, can be embodied as a unitary part of the supporting member 11, on the one hand, and the lever 13, on the other hand. Instead of elastic tongues or the like, elastic elements that can be moved longitudinally, like a spring-loaded slide, could be used which, in a mounting position comparable to the one illustrated in FIG. 3, would secure the lever 13 in its rotated position and, on the other hand, be deactivated by the casing 34 when it is inserted.

List of Reference Numerals

10 supporting member
11 first bearing bracket on 10 for 30
12 second bearing bracket on 10 for 30
13 lever for 30
13' rotated position of 13 for 30, favorable for mounting
14 free end of 13
15 rear attaching location on 13 for 31
16 receiving portion in 10 for 3 4
17 edge of 28
18 shoulder of 13
19 connecting location of 10 on 20
20 door, metal door panel
21 back side of 20
22 exposed side of 20
23 first recess of 20
24 second recess of 20
25 retaining element, leaf spring
26 v-shaped bent element of 25
27 fixed end of 25
28 cutout of 25
30 handle, lift-bar-type handle
31 first handle end of 30
32 second handle end of 30
33 hinge axle of 30
34 casing
35 insertion arrow of 34 into 10
36 space for 34 next to 30
37 inner end of 34

What is claimed is:

1. An exterior door handle for vehicles, the exterior door handle comprising:

a supporting member (10) mounted on a back side (21) of a door (20);

a handle (30), arranged on an exposed side (22) of the door (20) and configured to be moved from a rest position on the door (20) into an actuating position relative to locking elements by a pulling or rotating movement, wherein the handle (30) has handle ends (31, 32) having connecting portions, wherein the connecting portions protrude through door recesses (23, 24);

a lever (13) pivotably supported on the supporting member (10);

wherein at least one of the handle ends (31) of the handle (30) is connected to the lever (13), wherein, for attaching the at least one handle end (31) on the lever (13), the lever (13) is moved from an initial position into a rotated position (13') close to the door recess (23);

a casing (34) insertable into the supporting member (10) from the exposed side (22) of the door (20), wherein the casing (34), when inserted, is attached to the supporting member (10);

a retaining element (25) arranged between the supporting member (10) and the lever (13) and adapted to be automatically controlled between an active retaining position and an inactive release position;

wherein, when mounting the supporting member (10) on the door (20), the retaining element (25), for connecting the handle (30), is first positioned in the retaining position in which the retaining member (25) holds the lever (13) in the rotated position (13');

wherein the casing (34), upon insertion (35) into the supporting member (10), automatically moves the retaining element (25) into the release position so that the lever (13) is returned into the initial position.

2. The exterior door handle according to claim 1, wherein the retaining element (25) is comprised of a leaf spring engaging in the holding position the lever (13) or the support (10).

3. The exterior door handle according to claim 2, wherein the lever (13) has a shoulder (18) and the leaf spring has an end portion with a cutout (28), wherein the cutout (28), in the rotated position (13'), engages from behind the shoulder (18) formed by a rear surface of the lever (13).

4. The exterior door handle according to claim 3, wherein the leaf spring is attached (27) to the supporting member (10) and has an elastic, V-shaped bent end (26) protruding into a path of an insertion movement (35) of the casing (34, 37), wherein the casing (34, 37), when being inserted, bends the elastic end (26) of the leaf spring backwardly to such an extent that the leaf spring no longer protrudes into a path of a rotating movement of the shoulder (18).

5. The exterior door handle according to claim 1, wherein the casing has a lock cylinder acting on the lock elements.

* * * * *